US006021528A

United States Patent [19]

Jurga et al.

[11] Patent Number: 6,021,528

[45] Date of Patent: Feb. 8, 2000

[54] CHEST PROTECTOR HARNESS

[75] Inventors: Stan M. Jurga, Shirley, Mass.; Mike Chien-Fang Chen, Taipei Hsien, Taiwan

[73] Assignee: AMPAC Enterprises, Inc., Shirley, Mass.

[21] Appl. No.: 08/523,515

[22] Filed: Sep. 1, 1995

[51] Int. Cl.[7] ..... A41F 19/00

[52] U.S. Cl. ..... 2/326; 2/463

[58] Field of Search ..... 280/290; 244/151 R; 182/3, 4; 2/417, 418, 419, 421, 2, 326, 327, 328, 455, 456, 463, 464, 467, 323

[56] References Cited

U.S. PATENT DOCUMENTS

| | | | |
|---|---|---|---|
| 2,946,063 | 7/1960 | Boyer | 2/418 |
| 3,076,197 | 2/1963 | Glahe | 2/2 |
| 3,327,316 | 6/1967 | Pukish, Jr. | 2/421 |
| 3,916,446 | 11/1975 | Gooding | 2/421 |
| 4,651,356 | 3/1987 | Zide | 2/421 |
| 4,720,064 | 1/1988 | Herndon | 244/151 R X |

*Primary Examiner*—Peter Nerbun
*Attorney, Agent, or Firm*—Diller, Ramik & Wight, PC

[57] ABSTRACT

A baseball chest protector includes a protector pad to which is united a chest protector harness. The chest protector harness includes a generally Y-shaped harness back portion defined by a juncture portion, a pair of upwardly diverging arms and a generally downwardly projecting leg formed as a single piece of injection-molded synthetic polymeric or copolymeric material. A lower harness portion or spine portion is also formed as a single injection-molded piece of synthetic polymeric or copolymeric material and is united by an adjusting buckle to the leg or first part of the upper back harness portion. Adjusting buckles also adjustably secure a pair of elastic webs to the arm portions of the Y-shaped harness back portion and the elastic webs are each in turn secured by two injection molded harness top tab portions to shoulder areas of the protector pad of the baseball chest protector.

15 Claims, 1 Drawing Sheet

CHEST PROTECTOR HARNESS

BACKGROUND OF THE INVENTION

This invention is directed to a chest protector harness normally associated with a baseball chest protector of the type customarily worn by a baseball umpire, and the invention is specifically directed to a Y-shaped back harness which can be equally utilized in conjunction with work suspenders, back braces, tool belt supports, hockey suspenders, and the like.

A conventional baseball chest protector includes a relatively large and thick pad which protects the chest area of an umpire and includes a back harness which is conventionally made, at least in part, from numerous pieces of leather which must be cut, leveled, stitched and assembled with other metal (buckle) and elastic components in a variety of time-consuming operations. Harnesses of this type are, therefore, relatively expensive to manufacture and lack consistent quality.

SUMMARY OF THE INVENTION

The novel harness of the present invention includes a generally Y-shaped back harness or harness portion defined by a juncture portion from a first side of which downwardly projects a leg portion and from a second opposite side of which projects a pair of arm portions. Each arm portion is formed of first and second parts, as is the leg portion. The juncture and the first parts of the arm portions and the first part of the leg portion are a single piece injection molded from synthetic polymeric or copolymeric material. This eliminates the conventional method of forming the juncture portion from leather pieces and sewing ends of conventional separate leg and arm portions thereto.

An adjusting loop is associated with each first and second part of the arm portions and the leg portion which collectively impart three different points of adjustment of the harness which thereby offers a better fit to the user. This is particularly helpful because the second parts of the arm portions are preferably constructed from webs of elastic material which tend to stretch over protracted use and time, and irrespective of such stretching, the harness can be appropriately adjusted and readjusted, as necessary by an individual adjustment buckle associated with each arm portion. The overall length of the back harness can also be adjusted by a third adjustment buckle provided between the two parts of the leg portion.

The second part of the leg portion is integrally injection molded in conjunction with a bottom tab which has a pair of slots through which is threaded a waist strap of the chest protector. The latter integral molding also precludes the past practice of essentially sewing an end of the back harness to a bottom leather tab.

Plastic connecting tabs are also associated with the elastic webs of the arm portion second parts, and though they are stitched thereto, they are also injection molded from synthetic polymeric or copolymeric material which precludes the time-consuming process of cutting and shaping leather to an appropriate size, as well as leveling operations associated therewith to bring the leather to a desired thickness.

Due to the foregoing construction, the chest protector harness can be manufactured with high quality in a relatively rapid fashion and with a minimum of assembling operations and the end product is a harness which is extremely easy to adjust and offers better fit and longer life than that heretofore afforded by prior art chest protector harnesses.

With the above and other objects in view that will hereinafter appear, the nature of the invention will be more clearly understood by reference to the following detailed description, the appended claims and the several views illustrated in the accompanying drawings.

BRIEF DESCRIPTION OF THE PREFERRED EMBODIMENTS

Figures 1, 2, 3, 4, 5, 6:
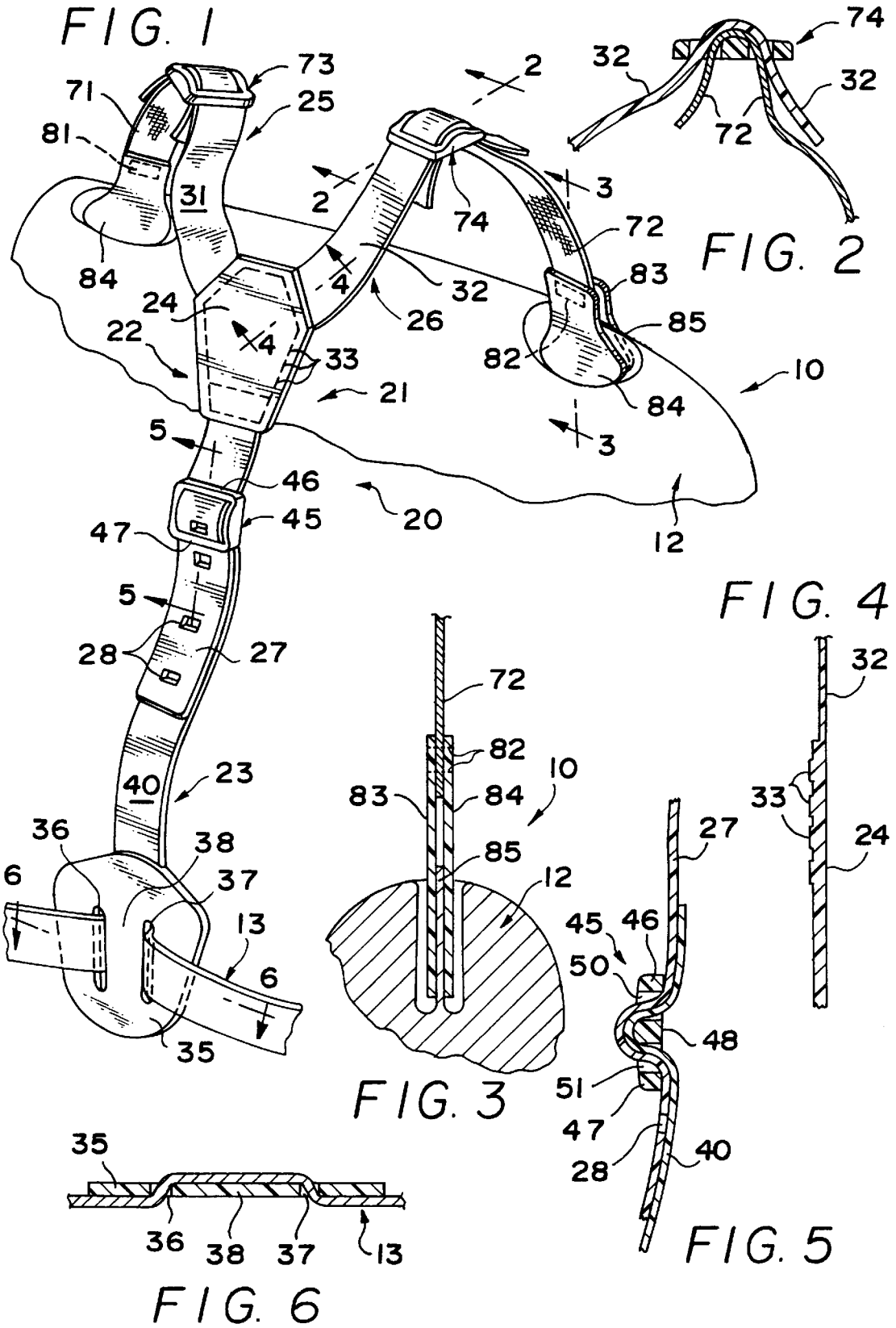
FIG. 1 is a fragmentary perspective view, and illustrates a baseball chest protector which includes a generally Y-shaped back harness portion formed of two components each injection molded from synthetic polymeric or copolymeric material.
FIG. 2 is an enlarged cross-sectional view taken generally along line 2—2 of FIG. 1, and illustrates the first part of an arm portion of the Y-shaped back harness connected by an adjusting buckle to a second arm part defined by an elastic web which is in turn joined to a shoulder portion of the chest protector.
FIG. 3 is an enlarged cross-sectional view taken generally along line 3—3 of FIG. 1, and illustrates the manner in which two harness top tab portions are connected to the protector pad.
FIG. 4 is an enlarged cross-sectional view taken generally along line 4—4 of FIG. 1, and illustrates the difference in cross-sectional thickness between a juncture portion and a first part of one of the arm portions of the back harness.
FIG. 5 is an enlarged cross-sectional view taken generally along line 5—5 of FIG. 1, and illustrates another adjusting buckle uniting first and second parts of the Y-shaped back harness to each other.
FIG. 6 is an enlarged cross-sectional view taken generally along line 6—6 of FIG. 1, and illustrates a waist strap threaded through slots of a bottom tab portion.

A baseball chest protector 10 includes a conventional protector pad 12 formed of shock-absorbing material and a waist strap 13 which is joined at opposite ends to opposite lower portions (not shown) of the protector pad 12 and normally includes an adjustable buckle (not shown).

In accordance with the present invention, a novel chest protector harness 20 is associated with the protector pad 12 and the waist strap 13 and jointly therewith defines the overall baseball chest protector 10.

The chest protector harness 20 includes a generally Y-shaped harness back portion 21 defined by an upper back harness portion 22 and a lower back or spine harness portion 23.

The upper back harness portion 22 is defined by a medial juncture portion 24, upper diverging arm portions or arm strap portions 25, 26 and a downwardly projecting leg portion leg strap portion first part or first strap part 27. The leg portion or first part 27 includes a plurality of rectangular openings 28. The arm portions 25, 26 include respective first parts or first strap parts 31, 32. The juncture portion 24 and the parts 27, 31, 32 constitute a single, one-piece, injection-molded member formed of synthetic plastic polymeric or copolymeric material. The thickness of the juncture portion 24 is approximately twice that of the parts 27, 31 and 32, as is most evident from FIG. 4. In addition, the juncture portion 24 includes on an upper surface (unnumbered) thereof a plurality of spaced thin raised ribs 33 (FIGS. 1 and 4) which simulate stitching, as is normally utilized in conventional baseball chest protector harnesses when the juncture portion 24 is formed of one or more pieces of leather and is sewn to three individual webs or straps corresponding to the integral parts 27, 31 and 32 of the upper back harness portion 22.

The lower back harness portion or spine or leg portion 23 is also a single piece of injection-molded polymeric or copolymeric material and includes a relatively thick bottom tab portion or first part 35 having a pair of parallel slots 36, 37 and a web 38 therebetween, and a second upper part second strap part or leg 40. The waist strap 13 is threaded through the slots 36, 37 and about one side of the web 38 in the manner relatively evident in FIGS. 1 and 6 of the drawings. The second part or leg 40 is threaded through adjusting means 45 in the form of an adjustment buckle through which is also threaded the first part 27 of the upper back harness portion 22, as is best illustrated in FIG. 5. The adjusting means or adjustment buckle 45 includes opposite side legs 46, 47 and a parallel spaced center leg 48 collectively defining slots or openings 50, 51 through which the parts 27, 40 are threaded and can be individually adjusted in a conventional manner. Edges (unnumbered) of the legs 46–48 are serrated (not shown) in a conventional manner to bite into and grip the parts 27, 40. If desired, the center leg 48 can be provided with a prong or tang for entering the apertures or openings 28 of the part 27 and similar openings or apertures (not shown) in the part 40. The adjusting or adjustment buckle 45 allows the wearer of the baseball chest protector 10 to adjust the vertical or spine length of the overall Y-shaped harness back portion 21 to accommodate wearer's of different heights and postures.

The arm portions 25, 26 include respective second parts 71, 72 in the form of elastic webs which are adjustably united to the respective first parts 31, 32 by respective adjusting means in the form of adjusting buckles 73, 74 corresponding identically to the adjusting buckle 45 of FIG. 5. The adjusting buckle 73, 74 are generally in the shoulder area of the wearer and allow further precise adjustment, not only depending upon the wearer's overall posture, build and height or size, but also to accommodate for eventual stretching of the elastic webs 71, 72 as occurs from excessive or lengthy use and wear.

The second parts 71, 72 have each sewn thereto by respective stitching 81, 82 a pair of harness top tab portions 83, 84 which are each formed from a single piece of injection-molded synthetic polymeric or copolymeric plastic material. The harness of injection-molded synthetic polymeric or copolymeric plastic material. The harness top tab portions 83, 84 have sandwiched therebetween a connecting portion 85 (FIG. 3) of the protector pad 12 in the area of each shoulder (unnumbered) thereof. The tab 85 can be sewn and/or adhesively bonded to the harness top tab portions 83, 84.

The entire chest protector harness 20 excludes leather and the disadvantages associated therewith. Instead, each of the components 22, 23, 83, and 84 is a single one-piece, injection-molded element which is thus of precise size, shape and thickness. The latter in conjunction with the three adjusting means 45, 73 and 74 assures a baseball chest protector 10 of high quality which is relatively easy to adjust and, therefore, offers better fit to a user. Additionally, either or both of the strap parts 27, 40 of the harness portion 23 can be constructed from elastic material.

Although a preferred embodiment of the invention has been specifically illustrated and described herein, it is to be understood that minor variations may be made in the apparatus without departing from the spirit and scope of the invention, as defined the appended claims.

What is claimed is:

1. A harness particularly adapted to be used in association with apparel comprising a generally Y-shaped harness portion defined by a juncture portion from a first side of which projects a leg strap and from a second opposite side of which projects a pair of arm straps, said leg strap including first and second leg strap portions, each of said arm straps including first and second arm strap portions, said Y-shaped harness portion including a single piece of molded polymeric or copolymeric plastic material defined by said juncture portion, said first leg strap portion and each of said first arm strap portions; said first arm strap portions diverge in a direction away from said juncture portion, means carried by said second leg strap portion for securing said second leg strap portion to associated apparel, means carried by each of said second arm strap portions for securing each of said second arm strap portions to associated apparel, said second leg strap portion being a separate element, means for securing said first and second leg strap portions to each other, and means for adjustably securing said first and second arm strap portions of each arm strap to each other.

2. The harness as defined in claim 1 wherein said first and second leg strap portions securing means is constructed and arranged for adjustably securing said first and second leg strap portions to each other.

3. The harness as defined in claim 1 wherein said second leg strap portion is constructed from a single piece of molded polymeric or copolymeric plastic material.

4. The harness as defined in claim 1 wherein each of said second arm strap portions is a separate elastic element.

5. The harness as defined in claim 1 wherein said leg strap portion includes an elastic part.

6. The harness as defined in claim 1 wherein each said arm strap portion includes an elastic part.

7. A harness particularly adapted to be used in association with apparel comprising a generally Y-shaped harness portion defined by a juncture portion from a first side of which projects a leg strap and from a second opposite side of which projects a pair of arm straps, each of said arm straps including first and second arm strap portions, said Y-shaped harness portion including a single piece of molded polymeric or copolymeric plastic material, defined by said juncture portion, said leg strap and each of said first arm strap portions; said first arm strap portions diverge in a direction away from said juncture portion, means carried by said leg strap for securing said leg strap to associated apparel, means carried by each of said second arm strap portions for securing each of said second arm strap portions to associated apparel, each said second arm strap portions being a separate element, means for securing each of said first and second arm strap portions of each arm strap to each other, and said last-mentioned securing means being constructed and arranged for adjustably securing each of said first and second arm strap portions to each other.

8. The harness as defined in claim 7 wherein each said second arm strap portions is a separate elastic element.

9. The harness as defined in claim 2 wherein said second leg strap portion is constructed from a single piece of molded polymeric or copolymeric plastic material.

10. The harness as defined in claim 2 wherein each said second arm strap portions is a separate elastic element.

11. The harness as defined in claim 10 wherein said second leg strap portion is constructed from a single piece of molded polymeric or copolymeric plastic material.

12. The harness as defined in claim 7 wherein said leg strap apparel securing means includes a separate strap portion.

13. The harness as defined in claim 7 wherein said leg strap apparel securing means includes a separate one-piece molded strap portion.

14. The harness as defined in claim 8 wherein said leg strap apparel securing means includes a separate strap portion.

15. The harness as defined in claim 8 wherein said leg strap apparel securing means includes a separate one-piece molded strap portion.

* * * * *